US005845580A

United States Patent [19]

Muller et al.

[11] Patent Number: 5,845,580

[45] Date of Patent: Dec. 8, 1998

[54] RAILWAY PLATFORM GAP FILLER

[75] Inventors: Richard J. Muller, 23 West 31st St., New York, N.Y. 10001; Milton P. Chernack, West Hempstead, N.Y.

[73] Assignee: Richard J. Muller, New York, N.Y.

[21] Appl. No.: 839,872

[22] Filed: Apr. 17, 1997

[51] Int. Cl.[6] ..... B61B 1/02

[52] U.S. Cl. ..... 104/31; 14/71

[58] Field of Search ..... 104/30, 31; 14/69.5, 14/71.1

[56] References Cited

U.S. PATENT DOCUMENTS

| | | | |
|---|---|---|---|
| 915,122 | 3/1909 | Shute . | |
| 937,375 | 10/1909 | Logan . | |
| 1,050,937 | 1/1913 | Gallinant | 104/31 |
| 1,079,651 | 11/1913 | Kintner . | |
| 1,098,298 | 5/1914 | Porth | 104/31 |
| 1,116,160 | 11/1914 | Swedberg . | |
| 1,189,689 | 4/1916 | Davidson . | |
| 1,216,560 | 2/1917 | Gallinant . | |
| 1,443,129 | 1/1923 | Hedley et al. . | |
| 5,517,921 | 5/1996 | Klohn | 104/31 |

*Primary Examiner*—S. Joseph Morano

*Attorney, Agent, or Firm*—Cohen, Pontani, Lieberman & Pavane

[57] ABSTRACT

An apparatus for dynamically filling a gap between a side of a railway train car and an adjacent edge of a station or loading platform for preventing accident or injury to passengers while boarding or alighting from the train. A plurality of flexible, flat planar sheet-like members project outwardly from a vertical platform edge surface that is confrontingly opposed to the side of a railway train car located adjacent to the platform. The extension of the projecting members from the platform is such that as an approaching train traveling along a track moves into proximity with the platform, the train contacts at least the free ends of the projecting members whereby the members are thereby resiliently deflected to assume a generally bent contour in the direction of train movement and thereby substantially fill the gap between the platform edge and the side of the train.

20 Claims, 8 Drawing Sheets

RAILWAY PLATFORM GAP FILLER

BACKGROUND OF THE INVENTION

1. Field of the Invention

The present invention relates generally to devices for decreasing the risk of accidents or injury to passengers boarding or leaving a railway train positioned adjacent to a station platform. More particularly, the present invention is directed to an apparatus for dynamically filling a gap between the side of a railway train car and an adjacent edge of a station or loading platform.

2. Description of Related Art

Railway trains have been in use as a popular mode of transportation for well over a century. In the course of its travel, a railway train stops at various train stations along a predetermined route to pick up and discharge passengers and/or cargo. During a typical stop, the railway train approaches and enters a train station and moves into a position of adjacent proximity with a station platform, aligning at least one of its sides with the station platform's edge. Invariably, there is a gap between the side of the train car and the edge of the station platform. This gap varies in size but may be quite significant, especially if the station platform or the apparatus to the platform is curved, and is typically in the range of 2 to 6 inches or more.

Passengers leave and board the train by stepping onto and from the station platform, respectively, through one or more train car doors positioned along the side of the train. The gap between the train and the station platform poses a danger to the boarding and alighting passengers who may accidentally fall partially or entirely into the gap. This danger is especially great with respect to elderly, handicapped, and young passengers. The gap also poses a danger to loading crews of freight trains. When freight trains are manually loaded, the loading crewmen, whose attention may be concentrated on their cargo, may inadvertently step into the gap and thus suffer an injury.

Over the years, a number of arrangements have been attempted or proposed to eliminate the danger posed by the gap between a train car and a station platform. However, all of these approaches involved or required complex mechanical contraptions that were expensive, difficult to install and maintain, and not especially reliable. Furthermore, because of their mechanical design many such gap-closing devices were functionally effective only when the arriving train traveled in one particular direction. To this day, none of these prior art devices have found practical use.

It would thus be desirable to provide an apparatus for dynamically filling the gap between the side of a railway train car and the adjacent edge of a station or loading platform that is easy and inexpensive to manufacture, install and maintain, that operates in an automated fashion not requiring human intervention nor reliant upon complex mechanical controls or electrical power and that will function in the intended manner irrespective of the direction from which the arriving railway train enters into a position of adjacent proximity to the platform.

SUMMARY OF THE INVENTION

The present invention is directed to an apparatus for dynamically filling the gap between a side of a railway train car and an adjacent edge of a station or loading platform, so as to provide a safety means for preventing accident or injury to passengers while boarding or alighting from the train. In accordance with the invention, a plurality of flexible flat planar sheet-like members project outwardly from the vertical platform edge surface that is commonly in confronting opposition to the side of the train car adjacent the platform and have aligned top edges so as to form a substantial continuation of the platform's top surface. The extension of the projecting members from the platform is such that as an approaching train traveling along the track moves into proximity with the platform, the train car contacts at least the free ends of the members whereby the members are resiliently deflected to assume a generally bent contour in the direction of train movement and thereby substantially fill the gap between the platform edge and the side of the train car.

The sheet-like members are preferably fabricated of a resiliently flexible material of sufficient strength to support the weight of persons who may inadvertently or otherwise step between the platform edge and the railway car. In order to strengthen the structural integrity of the members and to improve surface traction, each sheet-like member may incorporate integral ridges extending in or along the direction of the member's extension from the platform edge, at least but not necessarily limited to being along the top edge of each sheet onto which a person or passenger may step or stand.

Mounting of each sheet-like member on the vertical platform edge surface may be accomplished by either rigidly mounting the members along the vertical platform edge surface, or, preferably, by providing each sheet-like member with a vertical mounting edge-located key member or boss that slides vertically into a correspondingly-sized and shaped key slot extending downward from the platform's top surface along the vertical platform edge surface. This arrangement also facilitates ready removal and replacement of worn or damaged members which can simply be slid vertically out of (and a replacement member then slid vertically into) the appropriate slots.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote elements throughout the several views.

DETAILED DESCRIPTION OF THE PRESENTLY PREFERRED EMBODIMENTS

The present invention provides an apparatus for dynamically filling the gap between, by way of preferred and illustrative example, the side of a railway train car and an adjacent edge of a station or loading platform for preventing accident or injury to passengers while boarding or alighting from the train. In accompanying FIGS. 1–8, the apparatus of the present invention is shown disposed along a small portion of a station platform only by way of example. In a practical implementation of such an application, however, the apparatus preferably extends along a substantial portion of the station platform as will become more apparent as this description proceeds.

Figure 1:
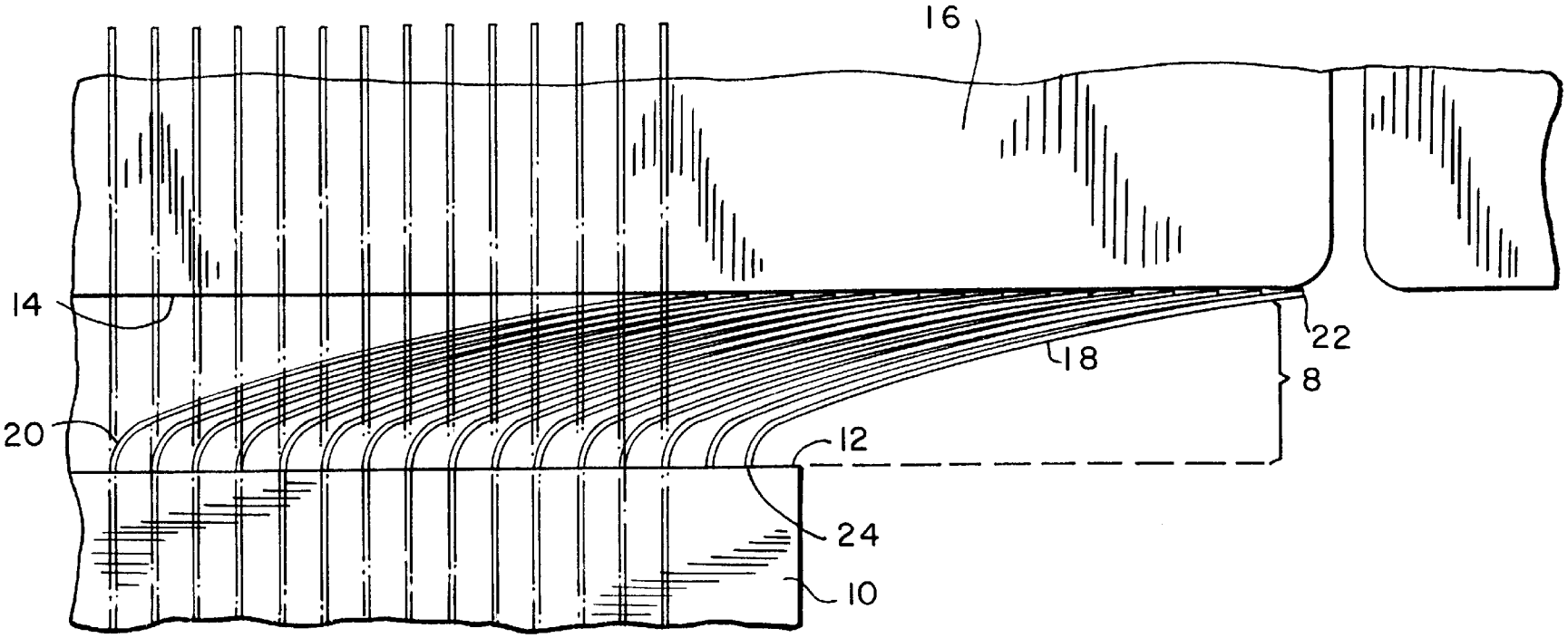
FIG. 1 is a top view of a first embodiment of the present invention.

Referring specifically to the drawings, and initially to FIG. 1 thereof, which depicts to a first embodiment of the invention a gap 8 is formed between a substantially vertical platform edge surface 12 of a platform 10 and a train car side surface or face 14 of a railway train car 16 when the train car approaches and enters a station and attains a position of adjacent proximity to the platform 10. In accordance with the invention, a plurality of resilient, flexible unitary and continuous sheet-like members 18 are preferably mounted in predetermined spaced apart relation to one another along the vertical platform edge surface 12. Each member 18 includes a distal edge portion 22 for contacting the train car side surface 14, a proximal edge portion 24 for mounting of the member 18 to the vertical platform edge surface 12, and a central bending area 20 therebetween defining the area at which each member 18 flexibly deforms or bends through contact by its distal portion 22 with the train car side 14. The members 18 are preferably unitarily fabricated of a resiliently flexible material, such for example as acetal or other plastic or a rubber-based material, of both appropriate flexibility and sufficient strength to assure a gradual bend while supporting the weight of persons or passengers who inadvertently or otherwise step into the gap 8. When there is no train in proximity with the platform 10, the members 18 extend outward substantially perpendicular or traverse to the vertical platform edge surface 12 so as to form, in effect, a substantial continuation of the platform 10 top surface.

When the train 16 approaches and moves into adjacent proximity to the platform 10, the train car side 14 contacts at least the distal portions 22 of the members 18 whereby the members 18 are resiliently deformed and deflected to assume a generally and gradually bent contour (as seen in FIG. 1), defined by and throughout and along the bending area 20, in the direction of train movement, and thus collectively substantially fill the gap 8.

As should now be apparent, the length or extension of each member 18—i.e. the distance from its securement to the platform surface 12 at its proximal edge portion 24 to its distal edge portion 22 for contact with a side surface 14 of a railway car—should be selected to accord with the particular gap that is formed when a railway car is located on the train track in adjacent proximity to the platform edge 12. The size or width of the gap will, of course, vary from station to station by virtue of the distance of the track from the particular platform and the specific type(s) of railway cars in use on that line. In any event, it is generally contemplated and intended that each member 18 will have a length or extension from the platform at least slightly in excess of the gap width. Clearly, the greater that excess extension, the greater the deformation or bending of the member that will take place as the train car moves into proximity with the platform. At the same time, it should be understood that at least a reasonable amount of bending of the members is desirable as such deformation of the plural, spaced members 18 will generally increase and enhance the ability of the members to support weight or forces applied, as by people entering and leaving the train car, to the top edges of the members 18. By way of example, for a four-inch gap width, it is generally contemplated that the members 18 be sized and formed to provide an outward projection of the undeformed members from the platform edge 12, when no train car is located adjacent the platform, of approximately 6 inches. Relatively lesser and greater extensions are nonetheless also within the intended scope and contemplation of the invention. The most preferred member extension, relative to the gap width, will also vary as a function of the exact material(s), and the properties thereof, of which the members are constructed, as well as with the particular configuration of the members as heretofore and hereinafter described in accordance with the various currently-preferred embodiments of the inventive apparatus.

Figure 2:
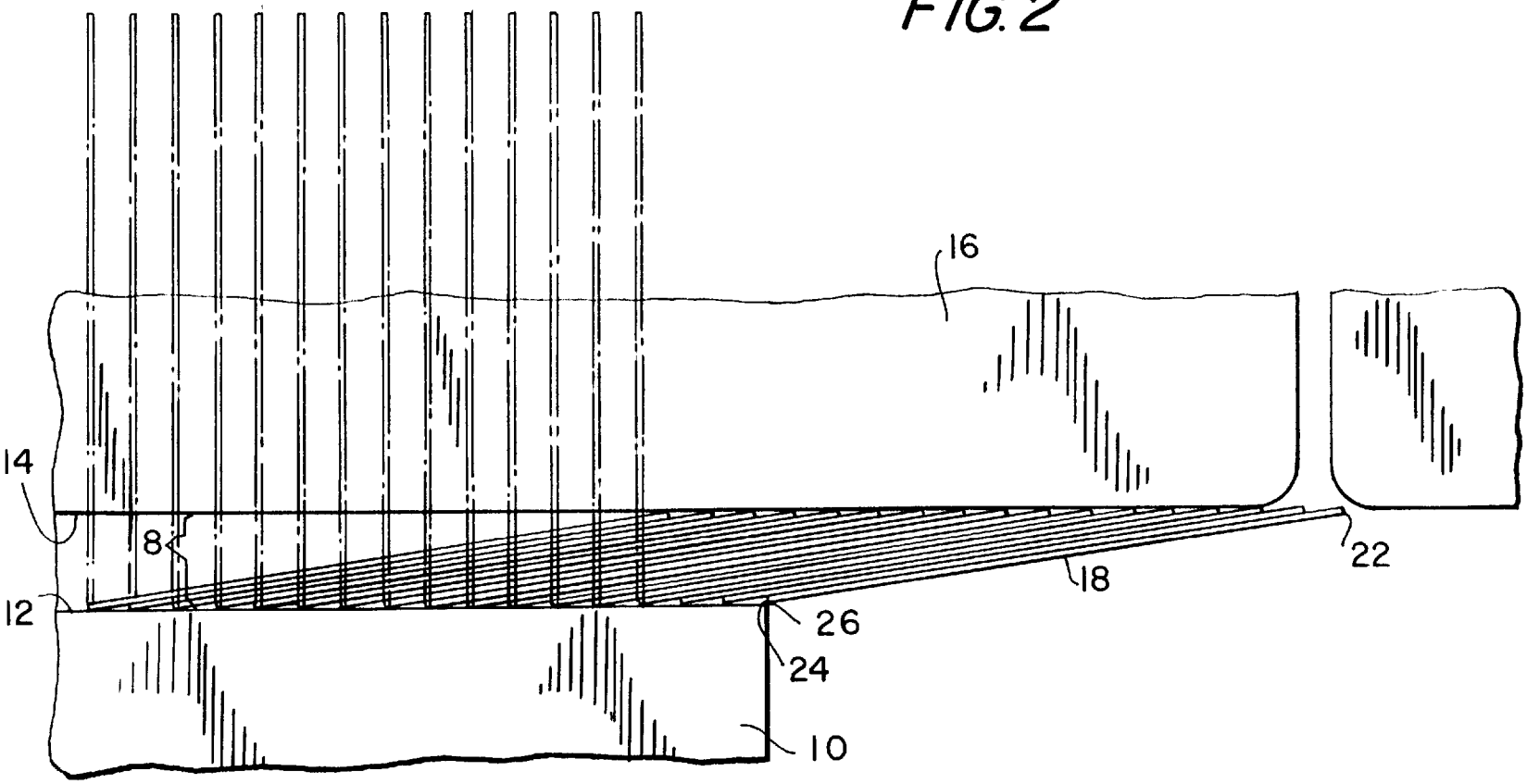
FIG. 2 is a top view of a second embodiment of the invention.

Referring now to FIG. 2, in this second embodiment of the invention the bending area 20 of each member 18 is replaced by one or a plurality of flexible hinges 26, such that when the train 16 moves into adjacent proximity to the platform 10 and the train car side surface 14 contacts at least the distal portion 22 of members 18, the member 18 is resiliently deflected to pivot as shown at and about the flexible hinge(s) 26 in the direction of movement of the train 16 so that the distal portions 22 contact one another, thus substantially filling the gap 8. The flexible hinges 26 are preferably an integral part of each member 18, and may, by way of example, be formed by reducing the thickness of a member 18 at a predetermined position along the member 18.

The member 18 of this second embodiment may be formed of the same types of materials as indicated above with respect to the first embodiment, although the material need not have the degree of resilient flexibility required in the first embodiment to accommodate the gradual bending deformation by which the members 18 of the first embodiment form the gap filling extension of the platform surface as a train car moves into adjacent proximity with the platform edge. Thus, significantly stiffer and less flexible materials may alternatively be employed, as a general matter of design choice, in this second embodiment of the inventive gap filling apparatus.

Both or either of the first and second embodiments of respective FIGS. 1 and 2 may also be modified to attach the distal ends or edge portions 22 of the members 18 together in predeterminately spaced apart relation. Such attachment may take the form of one or more relatively rigid or substantially flexible member or members—such for example as sheets or bars of a suitable material—disposed between and connecting adjacently-disposed ones of the gap filling members 18 at one or more locations vertically along the distal end portion 22 of each member 18, or a flexible wire or chain or the like merely sufficient to maintain a maximum separation or spacing between the distal edge portions of adjacent ones of the members 18. In each of the first and second embodiments the members 18 may be attached to the vertical platform edge surface 12 directly or by way of other suitable arrangements, all as described in greater detail below in connection with FIGS. 5 and 6.

Figure 3A:
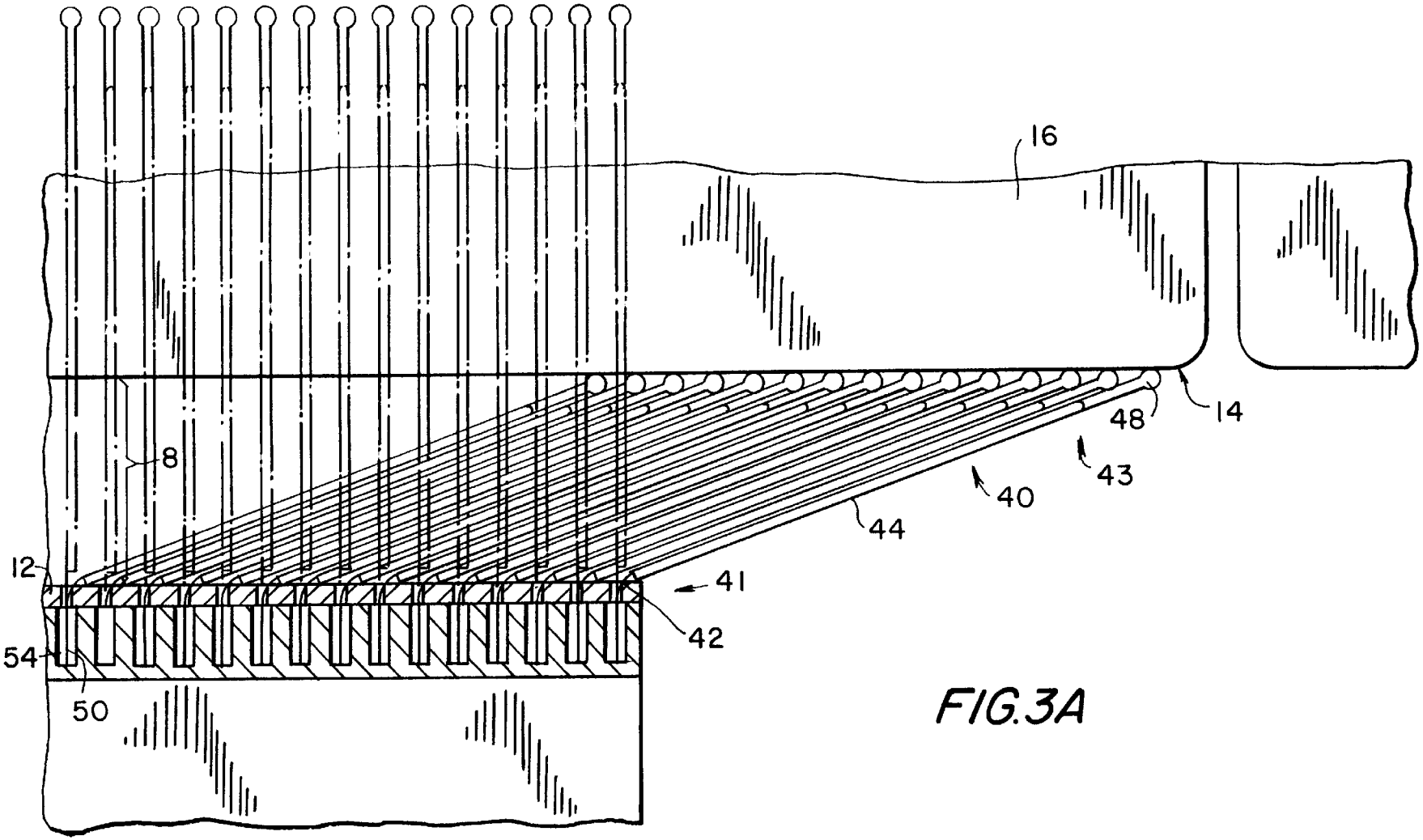
FIG. 3A is a top view of a third embodiment of the invention
Figure 3B:
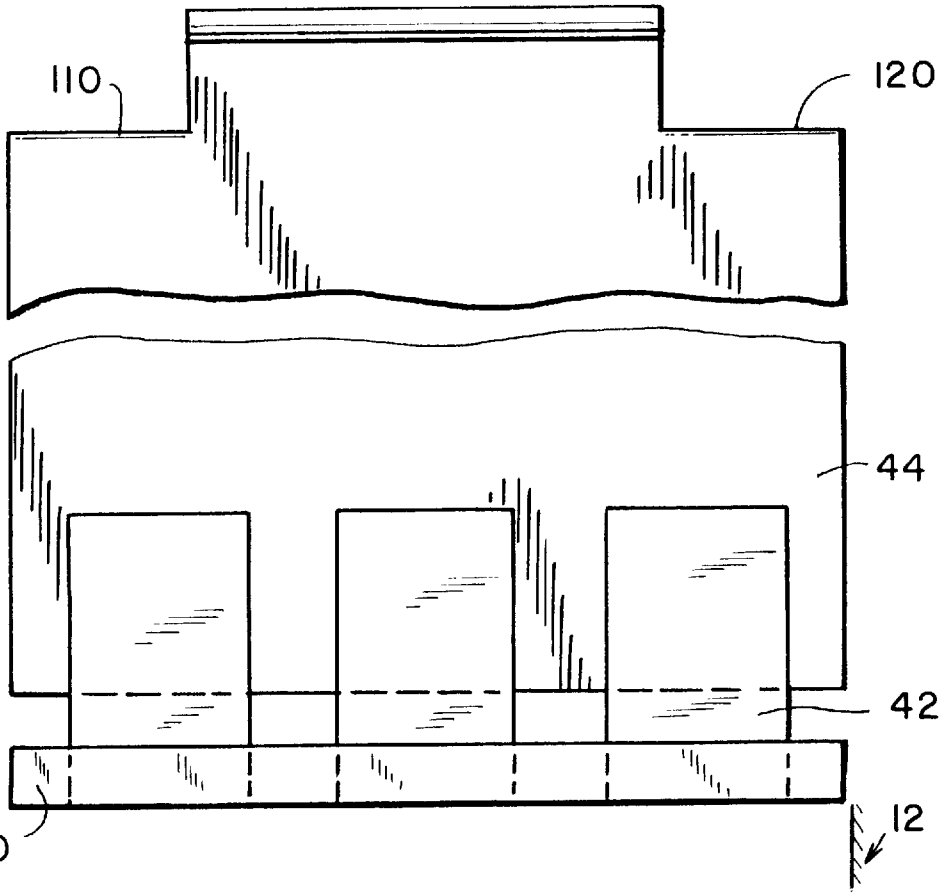
FIG. 3B is a side view of the third embodiment shown in FIG. 3A.
Figure 3C:
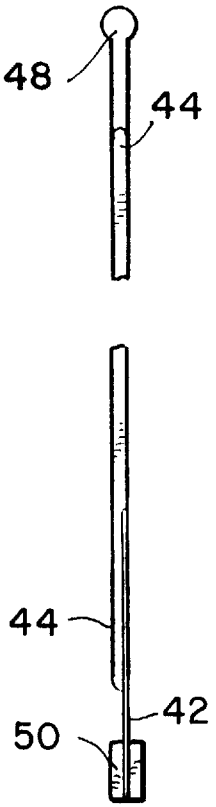
FIG. 3C is a top plan view of the gap-filling member of FIG. 3B.

Referring now to FIG. 3A, in a third and currently most preferred embodiment of the invention a plurality of sheet-like gap filling members 40 are similarly mounted in predetermined spaced apart relation to one another on and along and projecting outwardly from the vertical platform edge surface 12. Each member 40 is formed of a substantially rigid, flat planar sheet-like member 44 defining a proximal end portion 41 for operative disposition at least closely adjacent the platform edge surface 12 and a distal end portion 43 for disposal remote from the platform edge, an enlarged boss or key member 50 for securing the member 40 to the platform, and at least one resiliently flexible plate 42 for securing the key member 50 to the proximal end portion 41 of the member 44. The key member 50 may be formed of a pair of plates or bodies captively sandwiching therebetween one end of the flexible plate 42 and conjunctively defining a generally rectangular or otherwise predeterminately shaped or contoured element for engagement, as hereinafter described, with the platform 10. The other or opposite end of flexible plate 42 is secured to the proximal end portion 41 of member 44, as for example by adhesively or otherwise affixing plate 42 to one of the faces of member 44 as seen in FIG. 3A. The distal end or edge portion 43 of member 44 carries a train contact element 48 consisting of an enlarged head of the member 44 for contact with a train car. The contact element 48 may be formed as a unitary part of the member 44 or, as is preferred, as a separate element that is then integrally and replaceably secured to the member 44 at its distal end portion 43.

The flexible plate 42 provides a resiliently flexible and deformably bendable hinge for accommodating operative deflection of each gap filling member 40 from an initial position of nonuse (depicted in FIG. 3A) in which the members project outwardly from and substantially perpendicular to the platform edge surface 12, to a second position (also shown in FIG. 3A) in which each member 40 deformably bends at the plate 42 so that the sheet-like member 40 is angularly deflected by the approaching and proximally adjacent train car but otherwise remains substantially flat and unbent. To provide this functionality, the plate 42 may for example be fabricated of a resiliently flexible metal, such as spring steel, that has been treated to provide a suitable degree of weather-resistance. A single plate 42 may be provided along at least a substantial portion of the vertical extension of each sheet-like member 40 and corresponding key member 50 or, alternatively, a plurality of vertically shorter plates 42 may flexibly attach each member 40 and corresponding key member 50, as for example the three such flexible plates 42 depicted in FIG. 3B. In an alternate form of the embodiment of FIGS. 3A and 3B, the flexible plates 42 may be replaced or supplemented by one or more spring loaded hinges (not shown).

In a still further modification of this embodiment, the members 40 may be fabricated or formed unitary with the key members 50. In this construction, a reduced thickness area may be provided in each member 40 near and along the key member 50—i.e. in the region that, in the form shown in FIGS. 3A and 3B, comprises the space between the member 40 and the key member 50—to provide resilient flexibility in that reduced thickness area so that each member 40 is angularly deflected in the reduced thickness region through contact with the approaching and proximally adjacent train car. A flexible supplemental hinge member such as one or more of the flexible plates 42 may then be added to each member 40, in and preferably spanning the reduced thickness region from the key member 50 along proximal portion 41 to increase the overall stability and provide supplemental resilience for returning the member into a position extending outwardly transverse from the edge surface 12 when there is no longer a train car proximally adjacent the platform 10.

The key member 50 and sheet-like member 44 in each of these embodiments and variations may be and are preferably fabricated of a rigid material such as hard plastic or rubber or, less desirably, of weather-treated metal but, in any event, of a material providing sufficient strength and rigidity to support the weight of persons or passengers who may inadvertently or otherwise step into the gap 8. The contact element 48 is preferably fabricated of a durable, weather and—in view of its repeated forceful contacts with a train car—abrasion-resistant material such as a hard plastic. The use of a detachable contact element 48 will increase the longevity of the gap filling member 40 in that, should the contact element be damaged or wear out from repeated contacts with rapidly moving trains, it may then be replaced without discarding or requiring replacement of the entire member 40.

The platform 10 preferably includes a plurality of keyway slots 54, defined in spaced apart relation to one another and substantially corresponding in size and shape to the key members 50, each keyway slot 54 extending vertically downward along platform surface 12 from the top surface of the platform 10 for receiving and accommodating the key member 50 of a corresponding gap filling member 40. Thus, the members 40 are mounted to and along the vertical platform edge surface 12 by inserting each key member 50 of each gap filling member 40 into the top of a corresponding keyway slot 54, and sliding the key member 50 downward to the bottom of the keyway to fully seat and position the member 40 so that it extends perpendicular to the vertical platform edge surface 12 with its top edge aligned with the platform top surface. This arrangement advantageously permits the members 40 to be easily installed, removed and replaced as and when necessary. As should be apparent, a like arrangement may be employed for attaching the members 18 of the first and second embodiments, and the members 60 of the fourth embodiment hereinafter described, to the platform edge surface 12. In the case of the first, second and fourth embodiments, each member 18 or 60 may simply be provided at its proximal end with an enlargement sized and configured to conform to the size and shape of the keyway slots 54.

As a train 16 moves into adjacent proximity to the platform 10, the train side surface 14 contacts at least the contact members 48, causing the flexible plate 42 to flexibly bend whereby the members 40 are resiliently deflected in the direction of movement of the train 16 from their first to their second position so that the substantially rigid members 44 collectively effectively fill the gap 8.

Figure 4:
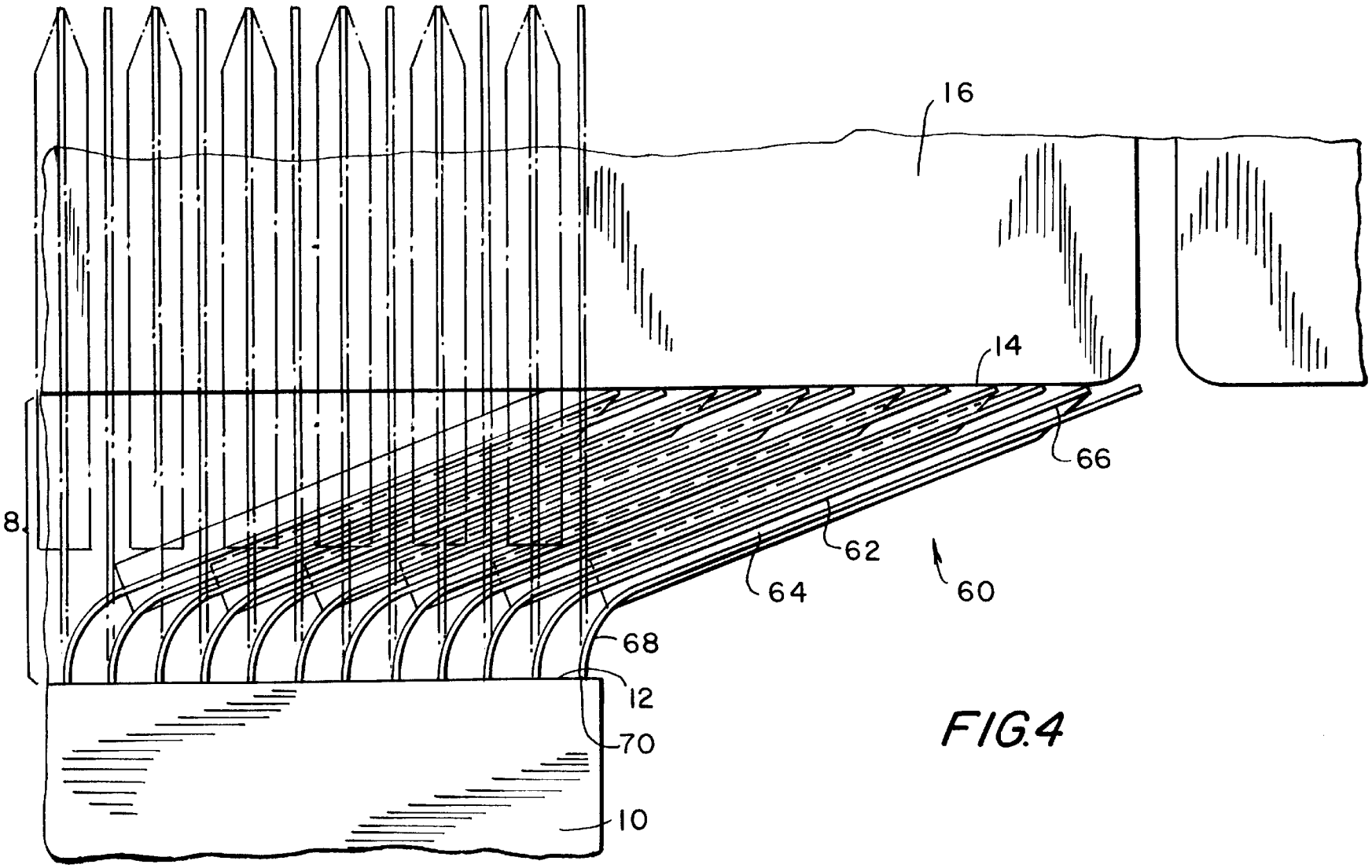
FIG. 4 is a top view of a fourth embodiment of the invention.

The fourth embodiment of the present invention shown in FIG. 4 is perhaps most similar to the first embodiment depicted in FIG. 1. In this case, however, a plurality of sheet-like members 60 are mounted in spaced relation to one another along the vertical platform edge surface 12, with each member 60 having a top edge disposed at a different vertical level relative to the immediately adjacent members 60, and the top edge of every other member 60 being disposed at the same vertical level. Each member 60 includes a proximal mounting portion 70 for attaching the member 60 to the vertical platform edge surface 12, a main or central portion 62 having a top edge, and a distal end remote from the platform. In addition, each member 60 carries a flat cap member 64 at least partially extending along and perpendicular to the top edge of and lying substantially perpendicular to the main portion 62 from proximate its proximal end to and terminating in a tapered or triangular contact portion 66 defined at its distal end for contact with the train car side surface 14. In addition to providing an integral planar surface area for supporting the weight of people and objects and for filling the gap 8, the cap 64 effectively inhibits unintended bending deformation of that portion of the gap filling members 60 over which it extends, thus defining in the remaining region or portion of each member 60 a bending area or region 68 positioned between the mounting portion 70 and the proximal end of cap 64 at which each member 60 resiliently and deformingly bends upon contact of the tapered distal end portion 66 of the cap with the train car side surface 14.

The members 60 may be fabricated of a resiliently flexible material, such as acetal or a rubber-based material, while the cap members 64 are preferably fabricated of a generally more rigid material of sufficient strength to prevent unintended deformation of that portion of the members 60 over which the caps are disposed and to non-deformably support the weight of persons or passengers who inadvertently or otherwise step into the gap 8. It is also within the intended scope and contemplation of the invention that the cap members 64 alternately formed be as unitary extensions of the top edge of the members 60.

When there in no train in proximity with the platform 10, the members 60 extend outward substantially perpendicular to the vertical platform edge surface 12. Because the members 60 are mounted at alternating height levels, every other cap member 64 is positioned below the higher mounted cap members 64 of the immediately adjacent members 60. Thus, even when the train 16 is not adjacent the platform 10, the members 60 provide an interleaved surface extending from the platform and forming a relatively stable, substantial continuation of the platform 10 top surface.

As the train car 16 moves into adjacent proximity to the platform 10, the train car side surface 14 contacts at least the tapered or triangular portions 66 of the members 60 so that the members 60 are thereby resiliently deflected to assume a generally bent contour at the bending area 68 to flexibly pivot the caps 64 and underlying portion of the members 60 in the direction of train movement. In this deflected state or condition of the members 60, the cap members 64, positioned at alternating heights, are relatively interleaved, as shown in FIG. 4, thus creating a nearly continuous effective surface substantially filling the gap 8.

The preferred manner of attaching the gap filling members 18, 60 of the first, second and fourth heretofore-described embodiments of the invention to the platform edge surface 12 may take any of several illustrative forms. In the first, which is perhaps most similar to that disclosed with respect to the third embodiment and is shown by way of example in FIGS. 5A and 5B, each gap filling member 18, 60 carries at its proximal end a key member enlargement 80 sized and shaped to substantially conform to the size and configuration of the keyway slots 54 defined in the platform edge surface 12. As seen in FIG. 5A, the slots 54 are disposed at a predetermined spacing along the platform 10 and each extends vertically downward along the edge surface 12 in substantially aligned depth or recessed relation with respect to the edge surface 12 so that the members 18, 60, all of which in a set of such members are of the same length between their proximal, key member enlargement-carrying ends and their distal, train-contacting edges, extend and project outwardly from the platform the same distance. Although a key member enlargement 80 of generally rectangular cross-section is depicted in FIG. 5A, it should be apparent that many alternative shapes and configurations of the enlargement or the like may alternatively be employed, as a general matter of design choice, to provide the intended captured securement of the gap filling members 18, 60 in the correspondingly-configured keyway slots 54 defined in the platform surface 12; this applies as well to the alternative mounting arrangement hereinafter described and shown in FIG. 6.

Figure 5B:
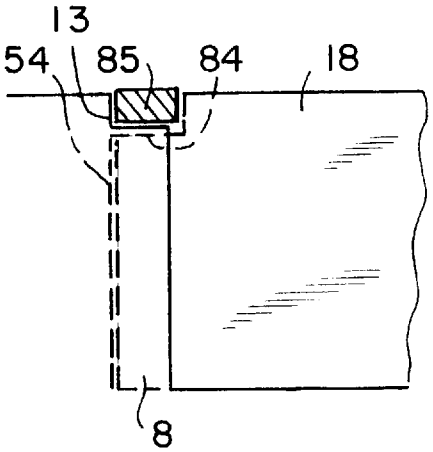
FIG. 5B is a side view of an additional embodiment of the first mounting arrangement of FIG. 5A.
Figure 5A:
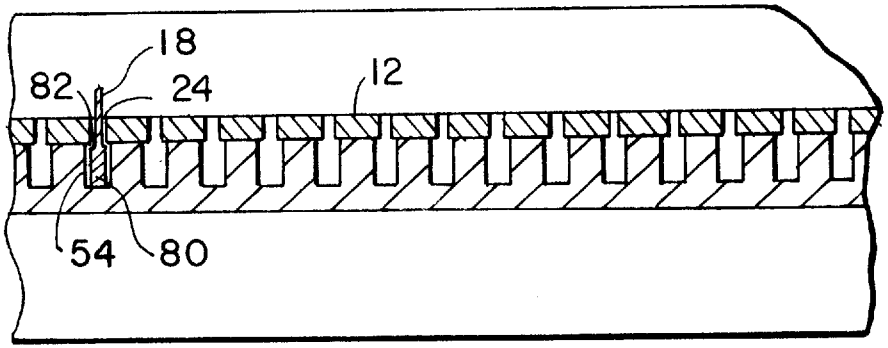
FIG. 5A is a top view of a first mounting arrangement for the various embodiments of the present invention.

The members 18, 60 may, by way of example be secured from unintended displacement or removal in their respective key slots 54 by the arrangement shown in FIG. 5B. A notch 84 defined in the upper distal corner of each member 18, 60 extends along an upper portion of the key member enlargement 80. A correspondingly sized notch 13 is defined in the platform 10 along the edge surface 12 above the keyway slots 54, so that when the members 18, 60 are inserted into their respective keyway slots 54, the notches 13 and 84 align to form a continuous channel extending substantially horizontally along the edge surface 12. A retaining bar 85 is then positioned within the so formed channel for preventing undesired displacement or removal of the members 18, 60 from their respective keyway slots 54. The retaining bar 85 is preferably sized and shaped to entirely fill the channel and thereby provide a smoothly continuous and effectively uninterrupted surface extending along and from the platform 10 to the top edges of the members 18, 60. The retaining bar 85 is removably attached to the platform 10 so that, when one or more of the members 18, 60 require replacement, the retaining bar 85 may be temporarily removed to allow the sliding to displacement and withdrawal of the particular members 18, 60 from their respective keyway slots 54.

Figure 6:
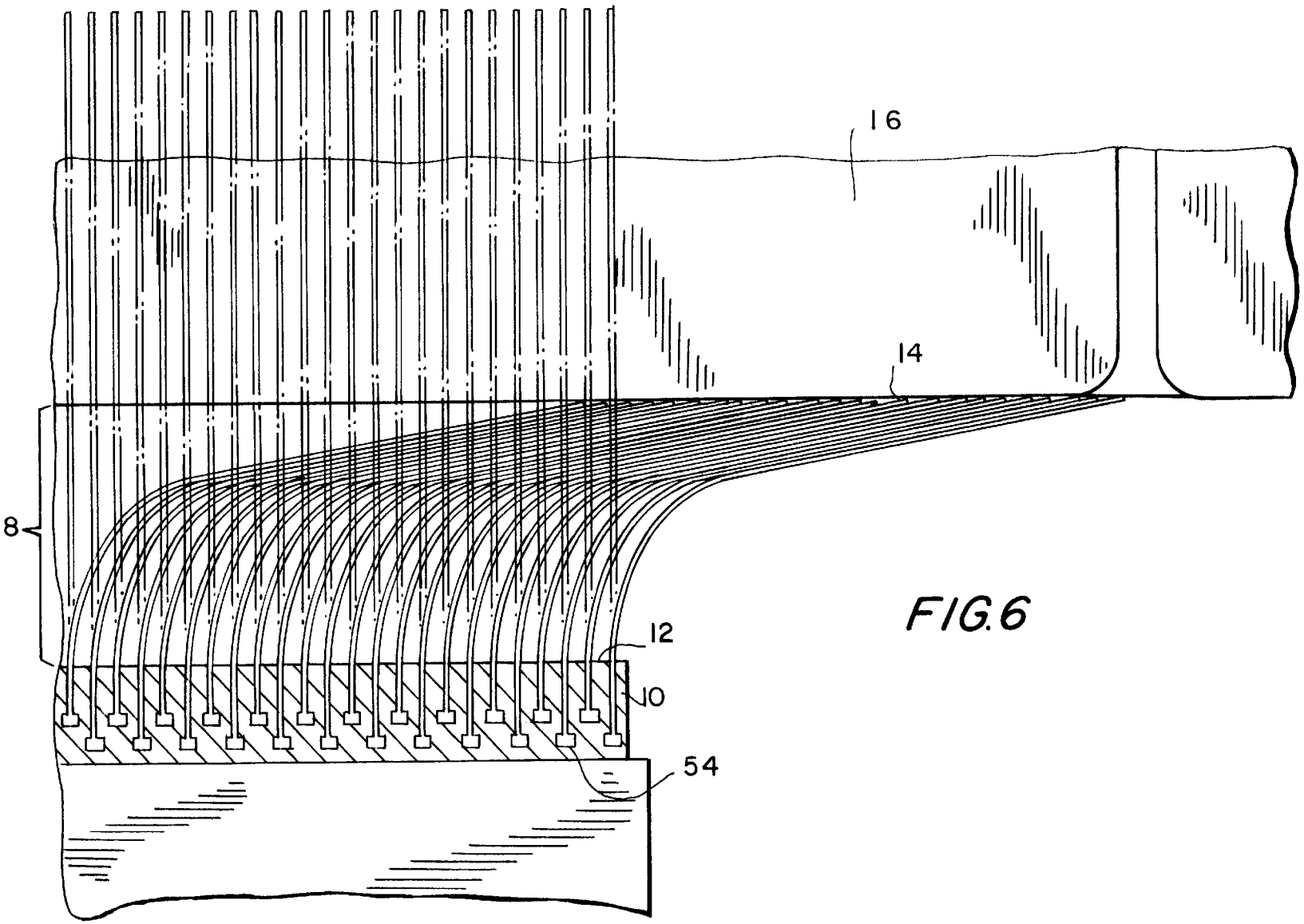
FIG. 6 is a top view of second mounting arrangement for the various embodiments of the present invention.

Referring now to FIG. 6, the primary difference to the FIG. 5 arrangement should be immediately apparent. In FIG. 6, the keyway slots 54 are staggered, depth or distance-wise from the platform edge surface 12. This requires, in order to maintain a commonality of projection of the gap filling members from the platform surface 12, that alternate gap filling members have a different length between their respective proximal and distal ends so that the distal ends of the gap filling members are aligned in their undeflected outward projection from the platform. Staggering of the positions of the keyway slots in this manner permits closer spacing of immediately adjacent gap filling members which, as will be recognized, provides increased density of the gap filling members to more effectively close the gap when a train car is positioned adjacent the platform and correspondingly increased supportability of the weight of people and objects stepping or placed thereon during use. FIG. 6 also depicts, by way of further illustrative example, a somewhat different cross-sectional configuration of the key members and keyway slots. It should be similarly recognized that numerous other equally satisfactory arrangements for captively securing the gap filling members to the platform are likewise within the intended scope and contemplation of the invention.

Figure 7:
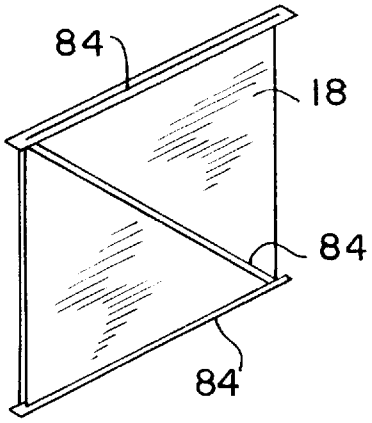
FIG. 7 is an isometric view of a fifth embodiment of the invention.

Referring now to FIG. 7, the gap filling members 18 are there shown each carrying or incorporating a cap 84 defining a narrow support surface along the top edge of the member and oriented substantially perpendicular to the central area or region 20 of the member 18 and, thereby, generally horizontal. The cap 84 of this further-modified embodiment of the invention is thus similar to the cap 64 of the third embodiment of FIG. 3A except that, as generally contemplated, the cap 84 will be narrower in size, will be formed as a unitary portion of the central area 20, and alternately-disposed caps may or may not be carried at different heights. The caps 84 in this form, however, in contradistinction to the caps 64, are primarily intended to strengthen the top edge of the members 18 and thereby (or otherwise) provide enhanced rigidity of the member 18 for supporting a person who may inadvertently or otherwise step into the gap while boarding or leaving an adjacently positioned train car. Accordingly, the cap 84 may also take the form of a rib—in lieu of a generally flat surface —and, in a still further modification, the rib (or a plurality of ribs) may be disposed not along the top edge of the member 18 but, instead (or in addition), at other locations along the vertical height of the member 18. It is likewise within the intended scope of the invention that such rib(s) be oriented and extend substantially horizontally along the central area 20 of the member 18, or at an angle to both the vertical and horizontal orientations of the member 18, again to provide enhanced structural integrity of the member 18 for supporting the weight of a person or object stepping or disposed thereon.

Figure 8:
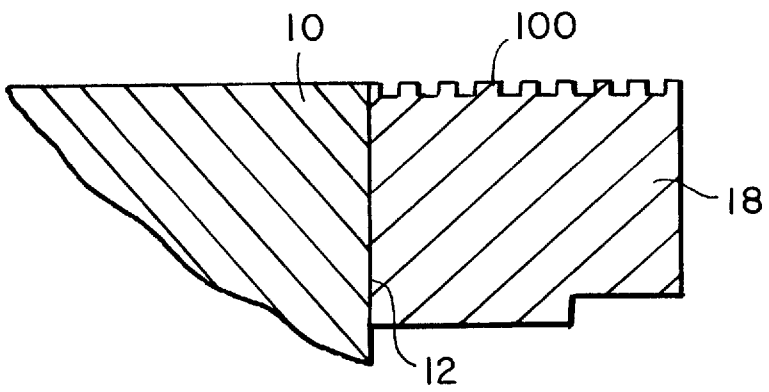
FIG. 8 is a side view of a sixth embodiment of the invention.

FIG. 8 depicts a modification that may optimally be applied to any of the embodiments of the present invention discussed above in connection with FIGS. 1–7. Specifically, a plurality of ridges 100 are defined along the top edge or surface of each sheet-like member, such as along the top surfaces of the caps 64, 84. The ridges 100 strengthen the structural integrity of the members and improve traction along the upper portions of the members.

Also applicable to each of the embodiments hereinabove described is the inclusion of an elongated bottom notch (FIG. 3B) that may be defined in the lower distal corner of each gap filling member. The bottom notch or contact is sized and shaped to avoid contact with the truck wheelbase portion and other lower protuberances of the railway cars as the gap filling members contact and are deflected by the train car side surface. The inclusion of the bottom notch 110 is particularly effective in preventing interference should the train car be required to reverse direction or back upon after moving into the station from its original direction of movement. Alternately, or in addition to the bottom notch 110, a top notch 120 (FIG. 3B) may be defined in the upper distal corner of each gap filling member for like functionality. Thus, the top notch should be sized and shaped to avoid contact with the door sills and other upper protuberances of the particular railway cars as the gap filling members contact and are deflected by the train car side surface.

Although specifically described herein for use in filling the gap between a station platform and a railway train car, the apparatus of the present invention is equally useful for filling similar gaps that are defined between platforms or surfaces and other vehicles such as boats, buses, and trucks. Minor modifications to the apparatus, such as varying the exact shapes or protrusions or cutouts of the sheet-like members, may be readily implemented as a general matter of design choice to accommodate such alternate uses. For example, when the apparatus of the present invention is installed on a truck loading platform where a truck moves, as by backing up, towards the platform along a direction perpendicular to the loading platform edge, the gap filling members may be installed along the platform edge so that they project outwardly from the platform in a predefined direction and at a predefined angle to the platform, so that when a rear portion of the truck contacts the distal ends of the members, the members are deflected in the predefined direction to fill the gap between the rear portion of the truck and the loading platform. Similarly, at a boat dock—where boats typically approach the dock edge generally parallel to the edge but, at the same time, moving perpendicularly toward the edge—the sheet-like members should project non-perpendicularly outward from the dock edge to predetermine the direction in which the members will be deflected toward the dock to fill a gap formed between the boat and the dock. Thus, the present invention is broadly applicable to a wide variety of applications and implementations, generally, although not exclusively, involving vehicles for filling such gaps.

Moreover, while there have shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. It is the intention, therefore, to be limited only as indicated by the scope of the claims appended hereto.

We claim:

1. An apparatus for dynamically filling a gap formed between an edge of a station platform and a side of a railway train car movable along a track into spaced apart adjacent proximity to the platform edge so as to prevent injury to passengers boarding and leaving the train car when the train car is positioned in spaced adjacent proximity to the platform edge, the station platform having a substantially horizontal platform top surface and a substantially vertical platform edge surface in spaced apart confronting opposition to the train car side when the train car is positioned in spaced adjacent proximity to the platform edge, said apparatus comprising:

a plurality of substantially flexible sheet-like members each having a top edge extending between a proximal end for securement to the platform edge surface and a distal end for contact with the train car positioned in spaced apart adjacent proximity to the platform edge; and securing means disposable on at least one of said platform and said plural sheet-like members for securing said members at said proximal end to said platform so that said members are adapted to project outwardly from the platform edge surface with said plural members predeterminately spaced apart along said platform edge surface and so that top edges of said sheet-like members are substantially aligned with the platform top surface to define a substantial continuation of said platform top surface beyond said platform edge;

said members being sized and configured and formed so that as the train car moves in a direction of travel into spaced apart adjacent proximity with the platform edge from which the members project, the member distal ends contact the train car side and the members are thereby resiliently deflected by the approaching train car from a first position in which the members project outwardly substantially transverse to the platform edge to a second position in which said members assume a generally bent contour in the direction of travel of the train car so that the bent top member surfaces collectively form a substantial continuation of the platform top surface from the platform edge to the train car side and thereby fill the gap between the platform edge and the train car side for preventing injury to passengers boarding and leaving the train car.

2. The apparatus of claim 1, wherein said securing means comprises:

a key portion having a predetermined size and shape and defined at said proximal end of each said member; and a plurality of keyway slots defined in and in spaced apart relation along the platform edge top surface, each said keyway slot being sized and shaped for captively receiving the key portion of one of said members to retain said one member for projection outwardly from the platform edge surface.

3. The apparatus of claim 2, wherein each said keyway slot is disposable so as to extend substantially vertically along the platform edge surface and wherein said key portions and said keyway slots are configured so that the key portion of each said member is removably slidable into and along a corresponding one of said keyway slots for releasably securing said members to the platform and for enabling ready selective removal and replacement of said members from said securement to the platform.

4. The apparatus of claim 3, wherein said securing means further comprises member retaining means, said member retaining means comprising:

a first cutout defined in a top portion of the proximal end of each said plural member and above the key portion;

a second cutout definable in the platform edge and extending substantially horizontally along the platform edge and above said keyway slots, said second cutout being sized and shaped so that when said plural members are inserted into their corresponding plural keyway slots, said second cutout is aligned with said first cutouts of each said plural member to thus form a channel extending substantially horizontally along the platform edge and above said keyway slots; and a retaining bar removably positioned within said channel and over said keyway slots for preventing unintended and unauthorized displacement of said plural members from their respective keyway slots, said retaining bar being sized and shaped to substantially fill said channel so as to provide a substantially continuous and uninterrupted surface from the top platform surface to the top member surfaces.

5. The apparatus of claim 1, wherein each said member further comprises a flexible hinge portion defined proximate said proximal end and configured so that said generally bent contour assumed by said members in said second position of said members is assumed at said flexible hinge portion.

6. The apparatus of claim 5, wherein each said member further comprises a central portion defined between said flexible hinge portion and said distal end, and wherein said each member is further configured so that the central portion remains substantially straight and unbent in said second position of said members.

7. The apparatus of claim 5, wherein each said member comprises a unitary body extending continuously from said proximal end to said distal end.

8. The apparatus of claim 7, wherein said flexible hinge comprises an area of reduced thickness of each said member.

9. The apparatus of claim 8, wherein said securing means comprises a first securement element on each said member and a plurality of second securement elements definable on said platform, and wherein said flexible hinge further comprises at least one resiliently flexible plate connected to said first securement element of said each member.

10. The apparatus of claim 5, wherein said securing means comprises a first securement element on each said member and a plurality of second securement elements definable on said platform, and wherein said flexible hinge comprises a resiliently flexible plate connected to said first securement element of said each member.

11. The apparatus of claim 5, wherein said member further comprises a cap element carried along at least a portion of the top edge of each said member and extending from said distal end toward said proximal end, said cap element defining a substantially horizontal surface along said each member top edge for facilitating filling of the gap and for limiting said generally bent contour of said members in said second position of the members to said flexible hinge portions of said members.

12. The apparatus of claim 1, wherein each said member further comprises an enlarged and predeterminately contoured head carried on the distal end of said each member for contact with a train car side as the train car moves into spaced apart adjacent proximity with the platform edge.

13. The apparatus of claim 12, wherein said enlarged head is releasably attachable at the distal end of said member for ready removal and replacement of said head.

14. The apparatus of claim 12, wherein said enlarged head is formed of a resiliently deformable material.

15. The apparatus of claim 1, further comprising an enlarged ridge defined along at least a portion of the top edge of each said member between said proximal and distal ends.

16. The apparatus of claim 1, further comprising an enlarged strengthening ridge defined along at least a portion of said member between said proximal and distal ends.

17. The apparatus of claim 16, wherein said ridge extends substantially parallel to the member top edge.

18. The apparatus of claim 1, each said member further comprising at least one cutout defined in said distal end and located and sized and configured for avoiding contact of said member with a train car protuberance extending outwardly beyond the train car side as the train car moves relative to and in spaced apart adjacent proximity with the platform edge.

19. An apparatus for dynamically filling a gap formed between an edge of a platform and a side of a vehicle movable into spaced apart adjacent proximity to the platform edge when the vehicle is positioned in spaced adjacent proximity to the platform edge, the platform having a substantially horizontal platform top surface and a substantially vertical platform edge surface in spaced apart confronting opposition to the vehicle side when the vehicle is positioned in spaced adjacent proximity to the platform edge, said apparatus comprising:

a plurality of substantially flexible sheet-like members each having a top edge extending between a proximal end for securement to the platform edge and a distal end for contact with the vehicle positioned in spaced apart adjacent proximity to the platform edge; and securing means diposable on at least one of said platform and said plural sheet-like members for securing said members at said proximal end to said platform so that said members are adapted to project outwardly from the platform edge surface with said plural members predeterminately spaced apart along said platform edge surface and so that top edges of said sheet-like members are substantially aligned with the platform top surface to define a substantial continuation of said platform top surface beyond said platform edge;

said members being sized and configured and formed so that as the vehicle moves in a direction of travel into spaced apart adjacent proximity with the platform edge from which the members project, the member distal ends contact the vehicle side and the members are thereby resiliently deflected by said contact with the approaching vehicle from a first position in which the members project outwardly at an initial predetermined angle from the platform edge to a second position in which said members are flexibly deformed so that the member distal ends are displaced toward the platform edge and the members assume a generally bent contour so that the bent top member surfaces collectively form a substantial continuation of the platform top surface from the platform edge to the vehicle side and thereby fill the gap between the platform edge and the vehicle side.

20. The apparatus of claim 19, wherein said securing means comprises means for securing said plural sheet-like members at an initial predefined angle with respect to said platform edge in an initial undeformed condition of the members, such that when the vehicle moves into spaced apart adjacent proximity to said platform edge, said plural members contact the vehicle at the member distal ends and the member distal ends are thereby deflected towards the platform edge.

* * * * *